US011697476B2

(12) United States Patent
Ekern et al.

(10) Patent No.: US 11,697,476 B2
(45) **Date of Patent: *Jul. 11, 2023**

(54) MULTI-LEVEL SEATING FOR A BOAT

(71) Applicant: MasterCraft Boat Company, LLC, Vonore, TN (US)

(72) Inventors: David F. Ekern, Knoxville, TN (US); Daniel P. Vieira, Madisonville, TN (US); Michael J. Uggeri, Knoxville, TN (US); Michael D. Myers, Knoxville, TN (US)

(73) Assignee: MasterCraft Boat Company, LLC, Vonore, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/675,079

(22) Filed: Feb. 18, 2022

(65) Prior Publication Data

US 2022/0169341 A1 Jun. 2, 2022

Related U.S. Application Data

(63) Continuation of application No. 16/667,248, filed on Oct. 29, 2019, now Pat. No. 11,267,538.

(60) Provisional application No. 62/751,834, filed on Oct. 29, 2018.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS

| | | | |
|---|---|---|---|
| 794,777 | A | 7/1905 | Bunnell |
| 2,971,568 | A | 6/1959 | Rorie et al. |
| 3,428,976 | A | 2/1969 | Robinson |
| 4,085,473 | A | 4/1978 | Franklin |
| 4,879,963 | A | 11/1989 | Dionne |
| D310,059 | S | 8/1990 | Porter |
| D322,422 | S | 12/1991 | Carlson |
| 5,136,963 | A | 8/1992 | Zuzik |
| D333,810 | S | 3/1993 | Wenstadt |
| 5,320,059 | A | 6/1994 | Ikeda |

(Continued)

FOREIGN PATENT DOCUMENTS

| | | | |
|---|---|---|---|
| WO | 20009/034522 | A2 | 3/2009 |
| WO | 2016/118872 | A1 | 7/2016 |

OTHER PUBLICATIONS

"Glastron GTS 187 2014 for sale for $24,000—Boats-from-USA;" boats-from-usa.com; available at https://boats-from-usa.com/glastron/glastron-gts-187-78531 (accessed Jun. 23, 2022).

(Continued)

*Primary Examiner* — Stephen P Avila
(74) *Attorney, Agent, or Firm* — Venable LLP

(57) ABSTRACT

A boat including first and second seats. The first seat has a first seating surface. The second seat has a second seating surface. The second seating surface may be at a level higher than the first seating surface. The second seating surface may be moveable between a retracted position and at least one raised position.

20 Claims, 8 Drawing Sheets

(56) References Cited

U.S. PATENT DOCUMENTS

| | | | |
|---|---|---|---|
| 5,346,277 | A | 9/1994 | Holobaugh et al. |
| 5,349,919 | A | 9/1994 | Douglass |
| 5,385,323 | A | 1/1995 | Garelick |
| D356,289 | S | 3/1995 | Trent |
| D357,223 | S | 4/1995 | Thompson et al. |
| 5,481,998 | A | 1/1996 | Trent |
| 5,497,724 | A | 3/1996 | Brown et al. |
| 5,795,017 | A | 8/1998 | Zimmerman et al. |
| 6,041,732 | A | 3/2000 | Ikeda |
| D429,682 | S | 8/2000 | Garland et al. |
| 6,145,458 | A | 11/2000 | Hattori |
| 6,257,667 | B1 | 7/2001 | Boren et al. |
| 6,371,559 | B1 | 4/2002 | Kienzle et al. |
| 6,431,109 | B1 | 8/2002 | Martin |
| D464,601 | S | 10/2002 | Aube et al. |
| 6,491,124 | B1 | 12/2002 | Thompson et al. |
| D469,053 | S | 1/2003 | Aube et al. |
| 6,672,240 | B1 | 1/2004 | Aube et al. |
| 6,837,173 | B2 | 1/2005 | Eck et al. |
| 6,886,490 | B2 | 5/2005 | Aube et al. |
| 7,000,557 | B1 | 2/2006 | Forbes et al. |
| D524,224 | S | 7/2006 | Guay et al. |
| 7,255,058 | B2 | 8/2007 | Forbes et al. |
| 7,513,211 | B1 | 4/2009 | Farb et al. |
| 7,661,382 | B2 | 2/2010 | Wood et al. |
| 8,113,136 | B2 | 2/2012 | Mayrand et al. |
| D665,719 | S | 8/2012 | Watkins et al. |
| D679,236 | S | 4/2013 | Gros et al. |
| 8,517,466 | B1 | 8/2013 | Wizorek et al. |
| 8,616,143 | B2 | 12/2013 | Hancock, Jr. et al. |
| D700,127 | S | 2/2014 | Fuller, IV |
| 8,899,168 | B1 | 12/2014 | Fodor et al. |
| 8,899,169 | B1 | 12/2014 | Jaziri |
| 9,003,997 | B2 | 4/2015 | Gratz et al. |
| 9,073,608 | B1 | 7/2015 | Foss et al. |
| D743,318 | S | 11/2015 | Curts |
| 9,650,117 | B2 | 5/2017 | Curts et al. |
| 9,821,887 | B1 | 11/2017 | Wilson et al. |
| D819,540 | S | 6/2018 | Wilson et al. |
| 10,065,711 | B2 | 9/2018 | Fuller, IV et al. |
| 11,230,355 | B1 * | 1/2022 | Curts ..... B63B 29/04 |
| 2008/0196649 | A1 | 8/2008 | Kalil |
| 2009/0301378 | A1 | 12/2009 | Walbridge et al. |
| 2010/0037814 | A1 | 2/2010 | Sahr et al. |
| 2010/0319604 | A1 | 12/2010 | Mayrand et al. |
| 2011/0095592 | A1 | 4/2011 | Willard et al. |
| 2013/0160695 | A1 | 6/2013 | Gratz et al. |
| 2014/0225403 | A1 | 8/2014 | Shimada et al. |
| 2016/0264217 | A1 | 9/2016 | Heimerl |
| 2017/0225751 | A1 | 8/2017 | Fuller, IV et al. |
| 2017/0233042 | A1 | 8/2017 | Curts et al. |
| 2018/0229816 | A1 | 8/2018 | Fafard et al. |
| 2018/0229817 | A1 | 8/2018 | Fafard et al. |

OTHER PUBLICATIONS

Mastercraft, 2013 Owner's Manual, pp. cover, ix, 2-23 to 2-26, and 3-27 to 3-28.

Charles Plueddeman, Surf Everywhere, Boating, Mar. 2015, pp. cover, 10, 68-73.

The AL-24 Wake Boat, http://pevati.com/al-24/, last visited Aug. 4, 2014.

Bombardier Recreational Products Inc., 210 Wake, Aug. 4, 2011.

Yamaha Motor Corporation, 2014 Yamaha Boats.

Sea Ray Boats, 300 Sundeck, Sep. 2012.

Chaparral Boats, 2013 Chaparral Fleet Brochure, available at http://www.chaparralboats.com/publications/uploaded_files/121/2013-ChapMini.pdf.

Randy Vance, Cobalt A25, Boating, Apr. 29, 2010, available at http://www.boatingmag.com/boats/cobalt-a25?mage=3.

Metal Moulding Corp., Slide Out, Flip Up, Rotating Hinge, http://www.metalmoulding.com/Slide_out_flip_up_rotating_hinge.html (last visited Aug. 31, 2015).

Sea Ray SLX 310 OB 2017, https://www.boattest.eom/oem/32/boats/3613/3.

International Search Report and Written Opinion, dated Sep. 9, 2020, in International Application No. PCT/US2019/058534.

Results of a Partial International Search and Provisional Opinion Accompanying the Partial Search Results, dated Feb. 4, 2020, in corresponding International Application No. PCT/US2019/058534.

Gary Polson, "Swim Platform Seats: An Attractive Nuisance?", PropellerSafty.com, Feb. 11, 2013, http://www.propellersafety.com/6893/legal - propeller/swim-platform-seats-attractive-nuisance/ (accessed: Feb. 20, 2020).

"Yamaha 210 FSH (2017-) Test Video—By BoaTEST.com", Nov. 3, 2017, https:,,www.youtube.com/watch?v=-mafntHQW7U (accessed: Feb. 20, 2020).

"The best superyacht aft views in the world", Jan. 24, 2020, https://www.boatinternational.com/yachts/editorial-eatures/best - superyacht-aft-views-27251 (accessed: Feb. 20, 2020).

* cited by examiner

MULTI-LEVEL SEATING FOR A BOAT

CROSS-REFERENCE TO RELATED APPLICATION

This application is a continuation of U.S. patent application Ser. No. 16/667,248, filed Oct. 29, 2019. U.S. patent application Ser. No. 16/667,248 claims the benefit under 35 U.S.C. § 119(e) of U.S. Provisional Patent Application No. 62/751,834, filed Oct. 29, 2018, and titled "MULTI-LEVEL AFT-FACING SEATING FOR A BOAT." The foregoing applications are hereby incorporated by reference in their entireties and are made a part of this specification for all that they disclose.

FIELD OF THE INVENTION

This invention relates to seating for a boat, particularly a seating configuration providing multi-level seating.

BACKGROUND OF THE INVENTION

Recreational boating is often a social activity in which more than three or four people are in a boat together. In addition, a number of boats may meet up and, for example, anchor or beach together. When boats meet up, the activity may switch from being focused within the cockpit of the boat to water activities off of the stern of the boat. In such a case, people may want to sit in aft-facing seats in the stern of the boat to watch or engage with persons participating in the water activities. However, existing aft-facing stern seating configurations generally do not have sufficient seating for all of the occupants of the boat. It is thus desired to have a boat with additional aft-facing seats and, in particular, additional aft-facing seats that are configured to provide a view of the water for all of the occupants of these seats.

SUMMARY OF THE INVENTION

In one aspect, the invention relates to a boat including first, second, and third aft-facing seats. The first aft-facing seat has a first seating surface. The second aft-facing seat has a second seating surface. The second seating surface is (i) forward of the first seating surface and (i) at a level higher than the first seating surface. The third aft-facing seat has a third seating surface. The third seating surface is (i) forward of the second seating surface and (ii) at a level higher than the second seating surface.

In one aspect, the invention relates to a boat including first and second seats. The first seat has a first seating surface, and the second seat has a second seating surface. The second seating surface is moveable between a retracted position and at least one raised position.

In another aspect, the invention relates to a boat including first and second seats. The first seat includes a main member having an upper surface and a moveable member having an upper surface. The upper surface of the main member is a first seating surface. The moveable member is moveable between a first position and a second position. In the first position, the upper surface of the moveable member forms a substantially flat surface with the upper surface of the main member, and, in the second position, the upper surface of the moveable member is inclined upward relative to the upper surface of the main member. The second seat has a second seating surface. The second seating surface is at a level higher than the first seating surface.

These and other aspects of the invention will become apparent from the following disclosure.

DETAILED DESCRIPTION OF THE PREFERRED EMBODIMENTS

As used herein, directional terms forward (fore), aft, inboard, and outboard have their commonly understood meaning in the art. Relative to the boat, forward is a direction towards the bow, and aft is a direction towards the stern. Likewise, inboard is a direction toward the center of the boat and outboard is a direction away from it.

Figure 1:
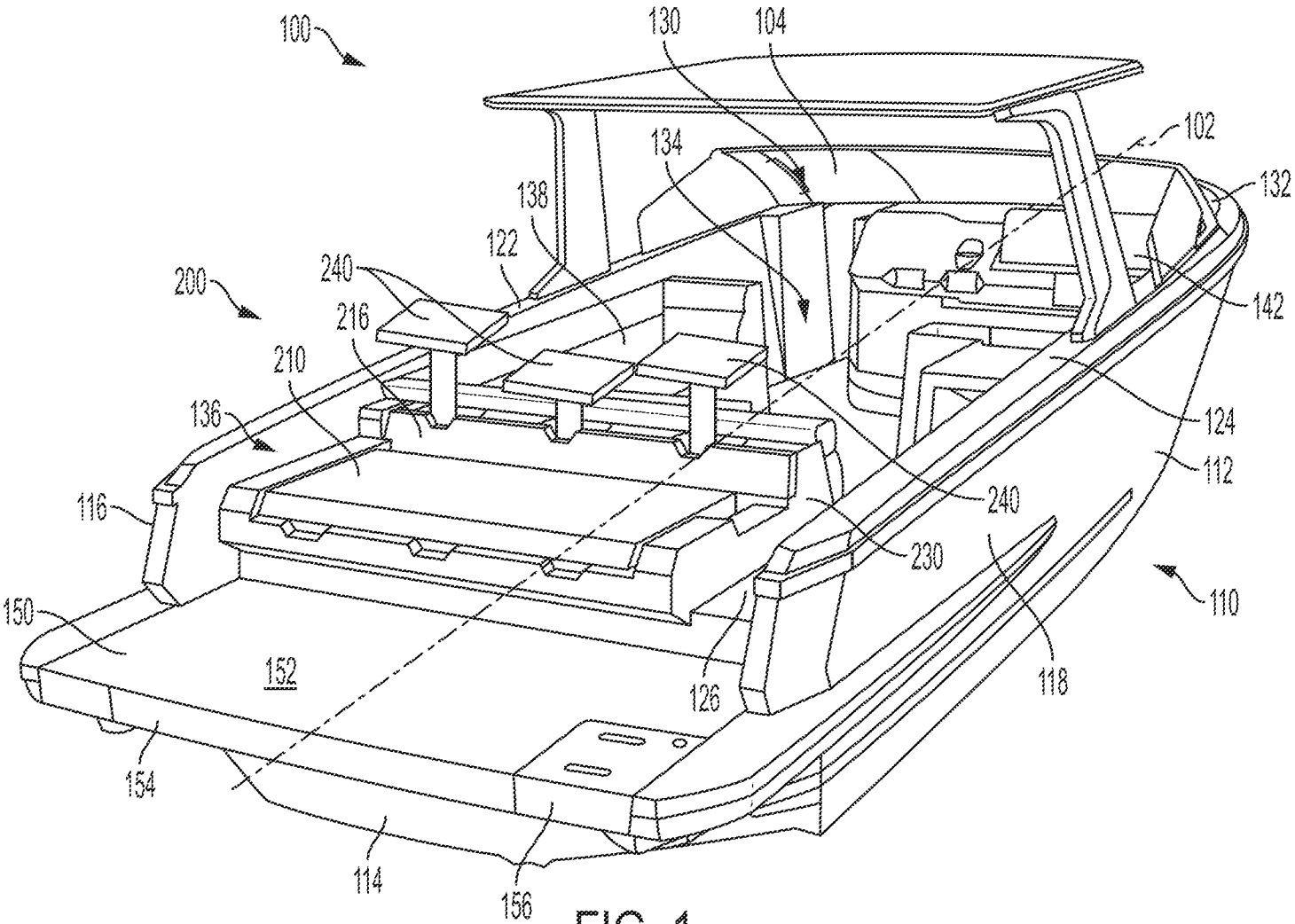
FIG. 1 shows a boat including an aft-facing seating configuration according to a preferred embodiment of the invention.

FIG. 1 shows a boat 100 having an aft-facing seating configuration 200 according to a preferred embodiment of the invention. The boat 100 includes a hull 110 with a bow 112, a transom 114, a port side 116, and a starboard side 118. The port and starboard sides 116, 118 have port and starboard gunwales 122, 124, respectively. The boat 100 has a centerline 102 running down the middle of the boat 100, halfway between the port and starboard sides 116, 118. Collectively, the bow 112, the transom 114, and the port and starboard sides 116, 118 define an interior 130 of the boat 100.

In the embodiment shown in FIG. 1, the boat 100 is a bowrider having a bow seating area 132 positioned in the bow 112 of the boat 100 and a primary seating area 134 (sometimes also referred to as the cockpit) positioned aft of a windshield 104. Although described in reference to a bowrider, this invention may be used with any suitable boat, including cuddies, center consoles, pontoon boats, and cruisers, for example. In addition, the boat 100 includes a stern seating area 136, which includes the aft-facing seating configuration 200. The stern seating area 136 is in the aft half of the boat 100 and, more preferably, in the aft third of the boat 100.

In the configuration shown in FIG. 1, the primary seating area 134 includes an L-shaped seat 138. One part of the L-shaped seat 138 is along the port side of the boat 100, and another is transverse to the centerline 102 of the boat 100. A forward elevated portion 234 of a seat support structure 230 will be described further below. In this embodiment, the seatback of the portion of the L-shaped seat 138 that is transverse to the centerline 102 is supported by a forward-facing surface of the forward elevated portion 234 of a seat support structure 230. Also within the primary seating area 134 is a control console 142 for operating the boat 100. Here, the control console 142 is positioned on the starboard side of the boat 100 proximate to and aft of the windshield 104.

Figure 2:
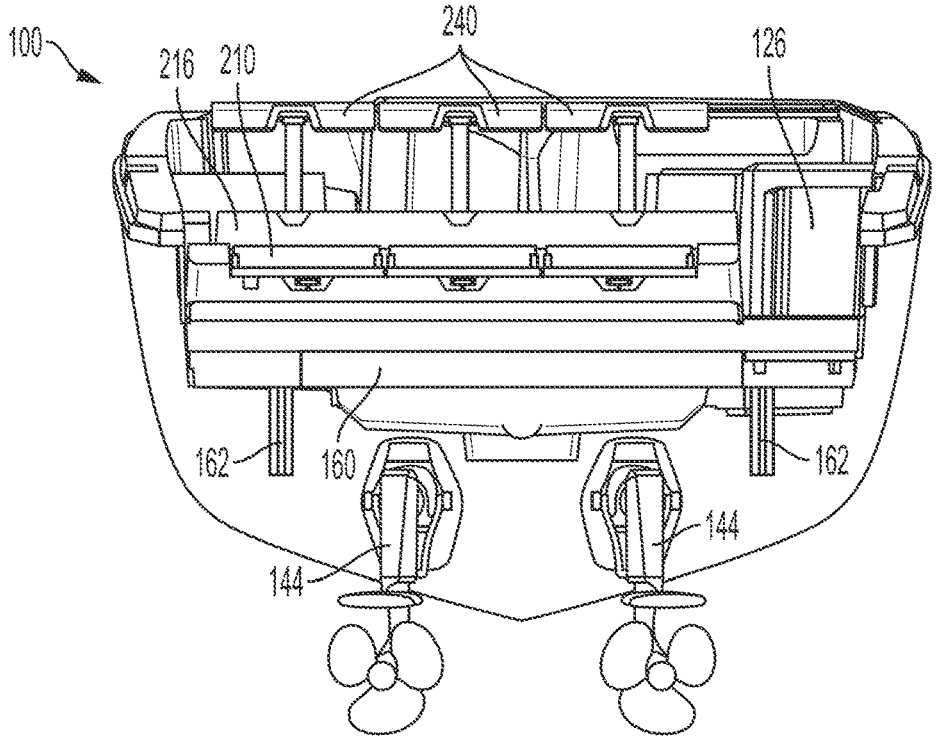
FIG. 2 is a stern view of another boat having the aft-facing seating configuration shown in FIG. 1.

In this embodiment, the boat 100 is a inboard/outboard (also referred to as a sterndrive) that includes two (inboard) motors (not shown), each connected to a sterndrive mechanism 144 (see FIG. 2). However, this invention can be utilized with other types of boats and propulsion systems, including but not limited to outboard motors, jet drives, inboards, and the like.

Figure 6:
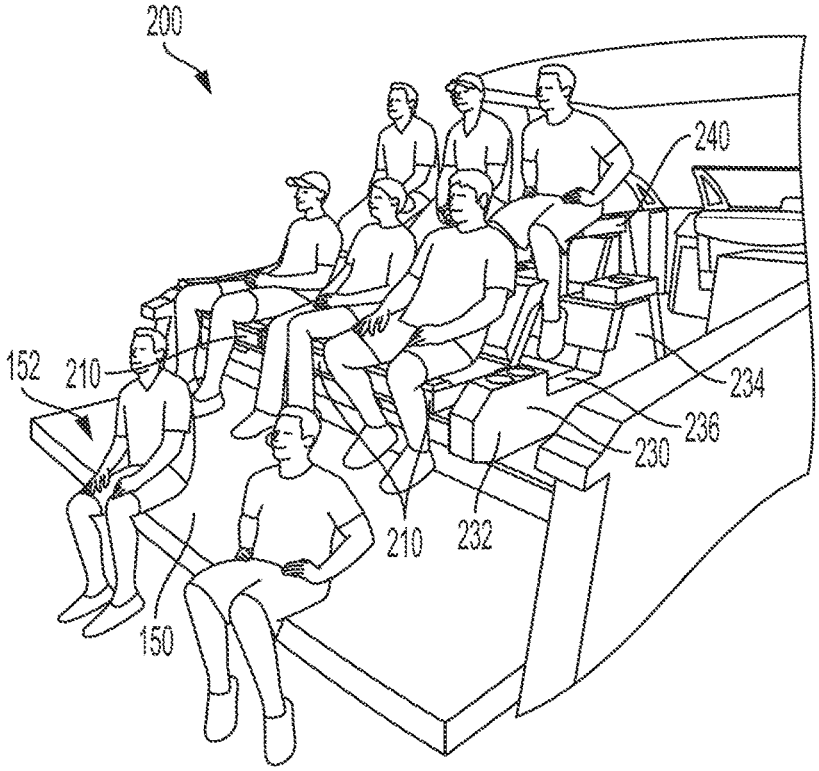
FIG. 6 is the aft-facing seating configuration shown in FIG. 5 with people seated in the aft-facing seating positions.

The boat 100 also includes a reboarding platform 150, which is sometimes also referred to as a swim platform. The reboarding platform 150 includes an upper surface 152 and a trailing edge 154. The reboarding platform 150, and in particular the upper surface 152, is generally horizontal. The reboarding platform 150 extends aft from the boat 100 and may be used to help people get in and out of the water. The reboarding platform 150 may include a ladder 156 that can be stowed in the reboarding platform 150 to assist with this purpose. The reboarding platform 150 may be used as a seat while the boat 100 is not moving through the water. For example, a person may sit on the upper surface 152 of the reboarding platform 150 with their legs over the trailing edge 154 of the reboarding platform 150 as shown in FIG. 6. Thus, as used herein, the reboarding platform 150 may be an aft-facing seat with the upper surface 152 being a seating surface, and the reboarding platform 150 may be a part of the aft-facing seating configuration 200. A person seated on the upper surface 152 of the reboarding platform 150 is not limited to the posture shown in FIG. 6 and described above, and the person may sit in other aft-facing postures including, for example, with their legs also on the upper surface 152 instead of over the trailing edge 154.

The reboarding platform 150 of this embodiment is formed integrally with the hull 110 of the boat 100 and positioned above the transom 114. The invention described herein is not limited to integral reboarding platforms. The invention may also be used on boats having, for example, a separate platform attached to the transom 114 or even with boats that do not have a reboarding platform 150. FIG. 2 shows an alternate stern of the boat 100 with a horizontal swim platform 160 attached to the transom 114. The swim platform 160 should be capable of supporting a human, and is preferably capable of supporting at least 500 lbs., and even more preferably 1250 lbs. The swim platform 160 may be constructed from any suitable material that may be used in a marine environment, including, for example, fiberglass and teak. In this embodiment, the swim platform 160 is attached to the transom 114 of the boat 100 using two brackets 162, and fasteners, such as screws, are used to attach the brackets 162 to the swim platform 160 and the transom 114. Any suitable means of attachment known in the art, however, may be used, including but not limited to bolts, rivets, welding, adhesive, and the like. Alternatively, the brackets 162 may be integrally formed into either the swim platform 160 or the transom 114 of the boat 100. Similarly, the swim platform 160 may be attached to the transom 114 by any suitable means and is not limited to the use of brackets 162.

Figure 3:
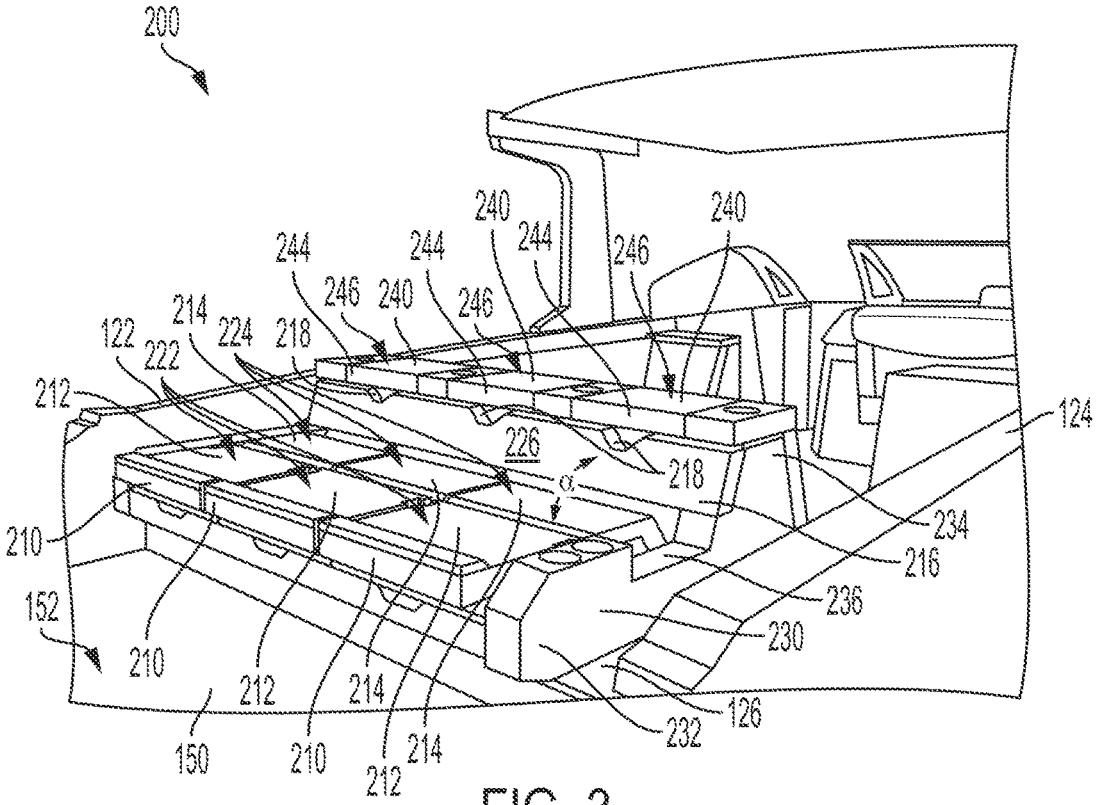
FIG. 3 is a perspective view of the boat shown in FIG. 1 with the retractable seats of the aft-facing seating configuration in their retracted position.
Figure 4:
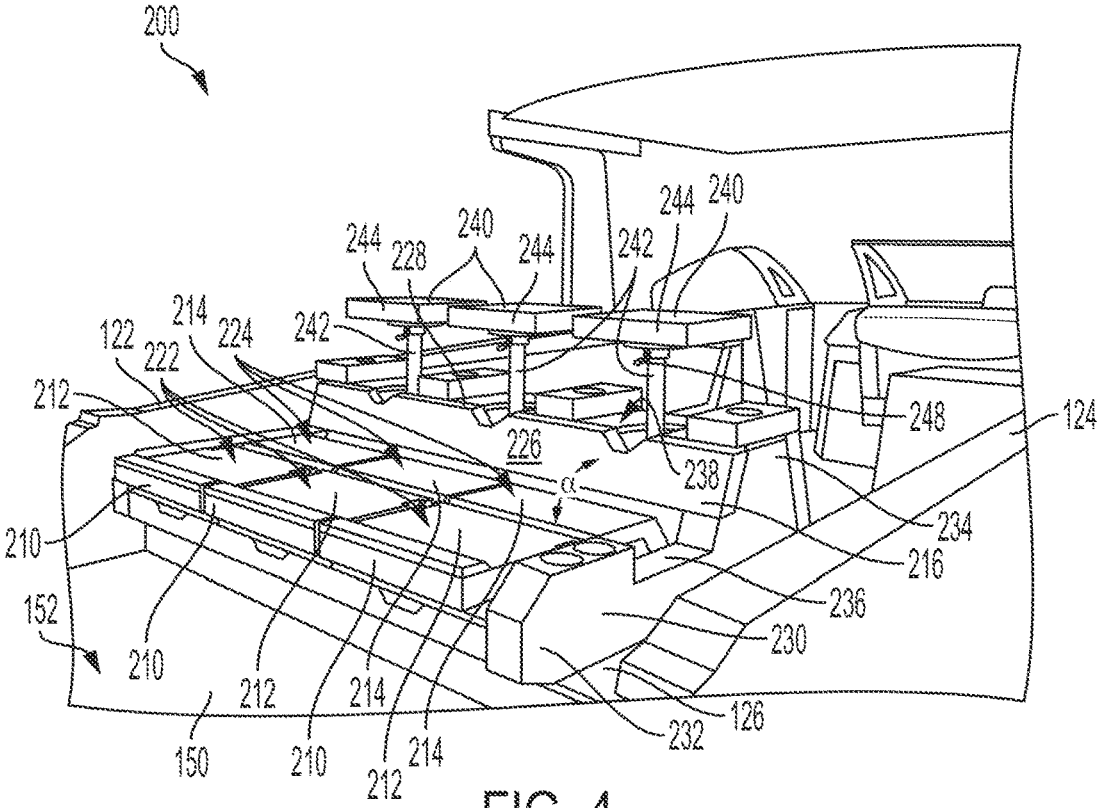
FIG. 4 is a perspective view of the boat shown in FIG. 1 with the retractable seats of the aft-facing seating configuration in a raised position and sun pad seats in a reclined position.

FIGS. 3-6 show an aft-facing seating configuration 200 according to a preferred embodiment of the invention. In this embodiment, the aft-facing seating configuration 200 includes first aft-facing seats 210 and second aft-facing seats 240. There are three first aft-facing seats 210 positioned adjacent to each other in this embodiment. Each first aft-facing seat 210 has similar features, and thus the description of one first aft-facing seat 210 applies equally to all three first aft-facing seats 210. As shown in FIGS. 3 and 4, the first aft-facing seats 210 are reclining or lounge style seats, which collectively form a sun pad. Thus, as used herein, the first aft-facing seats 210 will be referred to as sun pad seats 210. The sun pad seat 210 includes an aft member 212, a forward member 214, and a backrest 216. Each of the aft member 212 and the forward member 214 is a cushion attached to a structural member, such as a plate or a frame. Preferably, the cushions discussed herein (including those discussed below) are constructed from a soft but supportive material, such as triple-density foam, and are covered with a waterproof material, such as premium grade vinyl. Each of the aft member 212 and the forward member 214 also includes an upper surface 222, 224. In the configuration shown in FIGS. 3 and 4 (also referred to herein as a reclined position of the sun pad seat 210), the upper surface 222 of the aft member 212 and the upper surface 224 of the forward member 214 are at substantially the same the same height, forming a substantially flat surface of the sun pad. With each of the sun pad seats 210 in the reclined position, a person can, for example, lie on the sun pad. A person can also lounge on the sun pad seat 210 with their buttocks on the upper surface 224 of the forward member 214, legs or feet on the upper surface 222 of the aft member 212, and back on the backrest 216. A person also can sit on the sun pad seat 210 in any posture, including other the aft-facing postures, such as those discussed further below.

The aft-facing seating configuration 200 of this embodiment includes a seat support structure 230 supporting the sun pad seats 210. The seat support structure 230 includes two elevated portions of the deck of the boat 100: an aft elevated portion 232 and a forward elevated portion 234. As will be described further below, the aft elevated portion 232 is separated from the forward elevated portion 234 by a foot surface 236. The backrest 216 of the sun pad seats 210 is a cushion mounted to an aft-facing surface of the forward elevated portion 234. The backrest 216 includes an aft-facing surface 226 that is inclined relative to the upper surface 224 of the forward member 214 when the forward member 214 is in the reclined position. The aft-facing surface 226 of the backrest 216 is inclined at an angle $\alpha$ relative to the upper surface 224 of the forward member 214. Preferably, this angle $\alpha$ is 90° or greater, more preferably from 95° to 135°.

In this embodiment, the sun pad seat 210 is also configurable into an inclined position. In the inclined position, the forward member 214 is used as a backrest instead of a seating surface. The forward member 214 is moveable relative to the aft member 212 to form an angle β between the upper surface 224 of the forward member 214 and the upper surface 222 of the aft member 212. Preferably, this angle β is 90° or greater, more preferably from 95° to 135°. A pivot mechanism 228 is used to allow the forward member 214 to move between positions, and any suitable pivot mechanism 228 may be used, such as the pivot mechanisms shown and described in commonly-assigned U.S. Pat. No. 9,650,117 (the '117 patent), the disclosure of which is incorporated by reference herein in its entirety. If the pivot mechanisms of the '117 patent were used, for example, the forward member 214 could be attached like the headrest as disclosed in the '117 patent and moved between the reclined position and the inclined position manually by a person lifting the forward edge of the forward member 214 and moving it upwards and aft.

With the forward member 214 in the inclined position, a person can sit on the sun pad seat 210 with their buttocks on the upper surface 222 of the aft member 212, their back on the upper surface 224 of the forward member 214, and their legs over the aft elevated portion 232 of the seat support structure 230 such that their feet are on the upper surface 152 of the reboarding platform 150 as shown as shown in FIG. 6. In this configuration, the upper surface 222 of the aft member 212 is a seating surface and the person occupying the sun pad seat 210 is facing aft.

As shown in this embodiment, the person faces directly aft when the sun pad seat 210 is occupied; that is, the plane of the upper surface 224 of the forward member 214 and the aft-facing surface 226 of the backrest 216 are generally orthogonal to the centerline 102 of the boat 100. However, the sun pad seats 210 do not need to be positioned to face the occupant directly aft. Instead, variations are contemplated to be within the scope of the invention, including, for example, angling the upper surface 224 of the forward member 214 or the aft-facing surface 226 of the backrest 216 up to and including 45° relative to the centerline 102 of the boat 100.

The three sun pad seats 210 collectively preferably have a width that spans a majority of the beam of the boat 100, and more preferably at least two-thirds of the beam of the boat 100. In this embodiment, the three sun pad seats 210 extend across the entire beam of the boat 100 except for the port and starboard gunwales 122, 124 and a passageway 126 on the starboard side of the boat 100 connecting the primary seating area 134 with the reboarding platform 150. In the embodiment shown, each of the sun pad seats 210 is one third of the collective width of the three sun pad seats 210. Although described herein as three separate sun pad seats 210, the aft-facing seating configuration 200 is not so limited. Instead, for example, the aft-facing seating configuration 200 may have one sun pad seat 210 that is as wide as the three sun pad seats 210 collectively. Put another way, the first aft-facing seat 210 may be a bench-style seat when the forward member 214 is in the inclined position.

Figure 5:
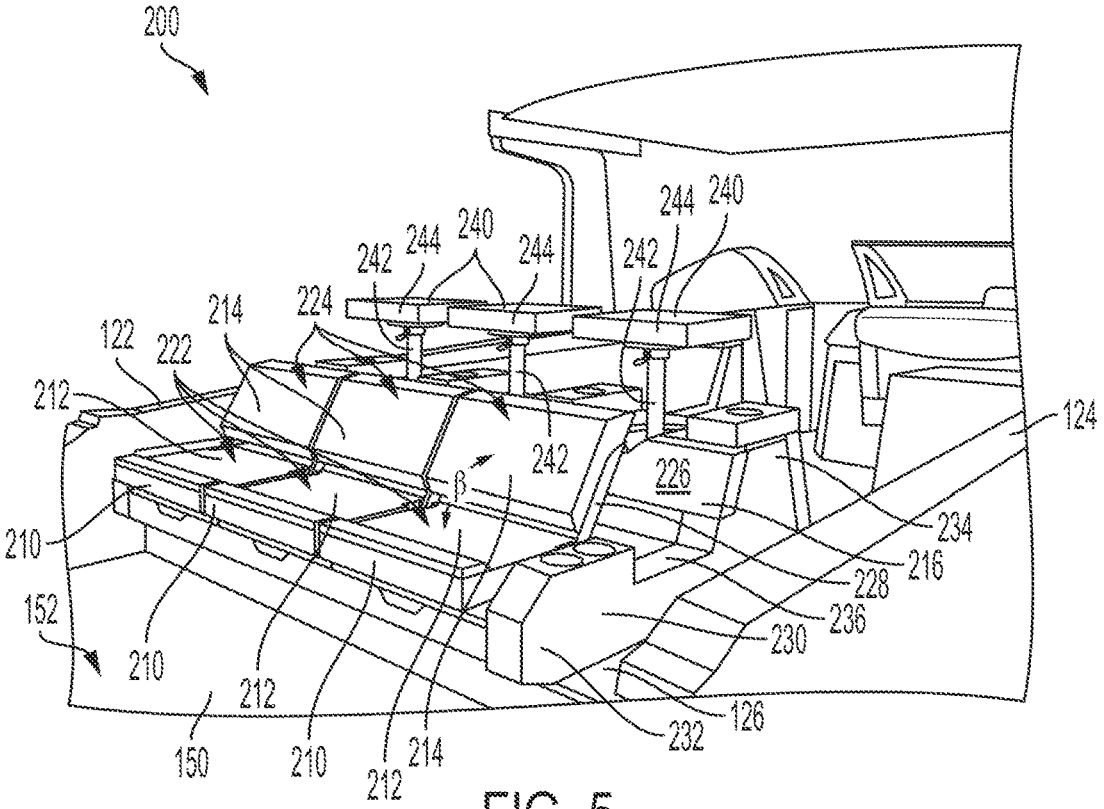
FIG. 5 is a perspective view of the boat shown in FIG. 1 with the retractable seats of the aft-facing seating configuration in the raised position and the sun pad seats in an inclined position.

The second aft-facing seat 240 of the aft-facing seating configuration 200 is retractable and moves from a retracted position to a raised position, and the second aft-facing seat 240 will also be referred to as a retractable seat 240 herein. FIG. 3 shows the retractable seat 240 in the retracted position, and FIGS. 4-6 show the retractable seat 240 in a raised position. There are three retractable seats 240 positioned next to each other in this embodiment. Each retractable seat 240 has similar features, and thus the description of one retractable seat 240 applies equally to all three retractable seats 240.

The retractable seat 240 of this embodiment is a pedestal-type seat with a pedestal 242 that supports a seat cushion 244 having an integrated plate on the underside of the cushion 244. The integrated plate supports the cushion 244 and connects the cushion 244 to the pedestal 242. Any suitable connection may be used, including bolting or welding, for example. The seat cushion 244 has an upper surface 246 which is a seating surface on which a person sits. In this embodiment, the retractable seat 240 is a stool-type seat and does not have a seatback.

In this embodiment, the retractable seat 240 is manually raised and lowered, but any suitable mechanism may be used to raise and lower the retractable seat 240 including a hydraulic cylinder or a linear electric actuator, for example. Although the retractable seat 240 may be solely manually operated (e.g., where the pedestal 242 comprises a cylinder that slides within another cylinder and has a lock to lock the cylinders relative to each other), the retractable seat 240 of this embodiment uses a pneumatic spring within the pedestal 242.

A lever 248 is located under the seat cushion 244 of the retractable seat 240. To raise the retractable seat 240, a person grabs the lever 248, which allows the pneumatic spring to raise the retractable seat 240 until the person releases the lever 248 or the pedestal 242 reaches its maximum height. To lower the retractable seat 240, a person applies a downward force to pneumatic spring while grabbing the lever 248. The downward force may be applied on the upper surface 246 of the cushion 244, such as by the person sitting on the cushion 244. While the lever 248 is grabbed and the downward force is applied, the seat lowers until the person releases the lever 248 or the retractable seat 240 is in its retracted position. In this embodiment, each of the retractable seats 240 has a plurality of raised positions and each of the retractable seats 240 is independently adjustable to one of the plurality of raised positions as can be seen in FIG. 1.

The forward elevated portion 234 of the seat support structure 230 has an upper surface 238. In the retracted position, the bottom of the cushion 244 rests on the upper surface 238 of the forward elevated portion 234. The forward elevated portion 234 also has a recess to accommodate the lever 248 of the retractable seat 240. The backrest 216 of each of the sun pad seats 210 includes an opening 218 that allows a person to put their hand through the opening 218 and raise the retractable seat 240 when it is in the retracted position to grab the lever 248.

In this embodiment, the pedestals 242 of the retractable seats 240 are aligned in a line that intersects to the centerline 102 of the boat 100, and preferably in a line that is orthogonal to the centerline 102 of the boat 100. Each of the retractable seats 240 is forward of the sun pad seats 210, and in this embodiment, the pedestal 242 of one of the retractable seats 240 is aligned with the center of a corresponding one of the sun pad seats 210. The pedestals 242 of the retractable seats 240 are positioned forward of the sun pad seats 210 such that an upper edge 228 of the backrest 216 of a corresponding sun pad seat 210 is underneath the cushion 244 of the retractable seat 240.

When an occupant is seated in an aft-facing position on the retractable seat 240, they are seated on the upper surface 246 of the cushion 244 with their feet aft, over the backrest 216 as can be seen in FIG. 6. When the forward member 214 of the sun pad seat 210 is in its inclined position, the forward member 214 exposes a portion 236 of the seat support structure 230. This portion 236 is referred to herein as a foot surface 236 of the deck and is a place on which a person seated on the retractable seats 240 can place their feet.

As can be seen in FIG. 6, the aft-facing seating configuration 200 of this embodiment provides for comfortable multi-level aft viewing positions. In this embodiment, the upper surface 246 of the cushion 244 of the retractable seat 240 is higher than the upper surface 222 of the aft member 212 of the sun pad seat 210 in all positions. This allows the person seated on the retractable seat 240 to be comfortably seated with their view in the aft direction unobstructed by the person in front of them seated on the sun pad seat 210. In this embodiment, the upper surface 246 of the cushion 244 of the retractable seat 240 is preferably adjustable from the retracted position to a height of 24 inches above its position in the retracted position. The upper surface 246 of the cushion 244 of the retractable seat 240 is preferably nine inches above the upper surface 222 of the aft member 212 of the sun pad seat 210. The upper surface 222 of the aft member 212 of the sun pad seat 210 is preferably positioned higher than the upper surface 152 of the reboarding platform 150, such as 16 inches above the upper surface 152 of the reboarding platform 150. When the upper surface 152 of the reboarding platform 150 is used as a seating surface, the occupants of both the sun pad seats 210 and the retractable seats 240 can be comfortably seated with their view in an aft direction unobstructed by the person in front of them seated on the reboarding platform 150. As discussed herein, the various seating surfaces are higher or lower than one another. In this embodiment, these positions are determined relative to the plane of the upper surface 152 of the reboarding platform 150 when the boat 100 is in its static flotation condition.

Figure 7:
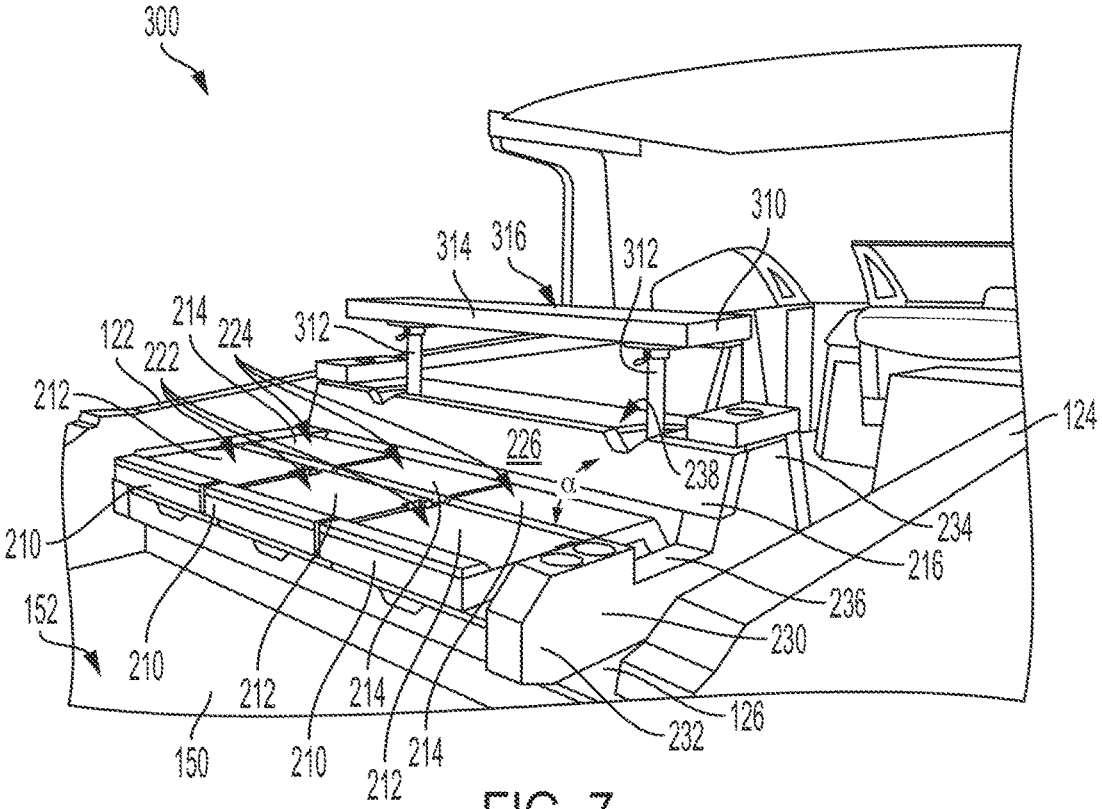
FIG. 7 is the view of FIG. 4 showing an alternate configuration of the retractable seat.

In the embodiment discussed above, the aft-facing seating configuration 200 has three retractable seats 240. The aft-facing seating configuration 200 is not so limited, however. FIG. 7 is the view of FIG. 4 showing another embodiment of an aft-facing seating configuration 300. The aft-facing seating configuration 300 of this embodiment has one retractable seat 310. The retractable seat 310 of this embodiment is a bench-style seat that has two pedestals 312 supporting either end of an elongated cushion 314. The elongated cushion 314 has an upper surface 316 which is a seating surface on which multiple people can sit. Preferably, the retractable seat 310 has a width that is similar to that of the collective width of the sun pad seats 210, such as a majority of the beam, for example. The retractable seat 310 of this embodiment is in other ways similar to the retractable seats 240 discussed in the preceding embodiment.

Figure 8:
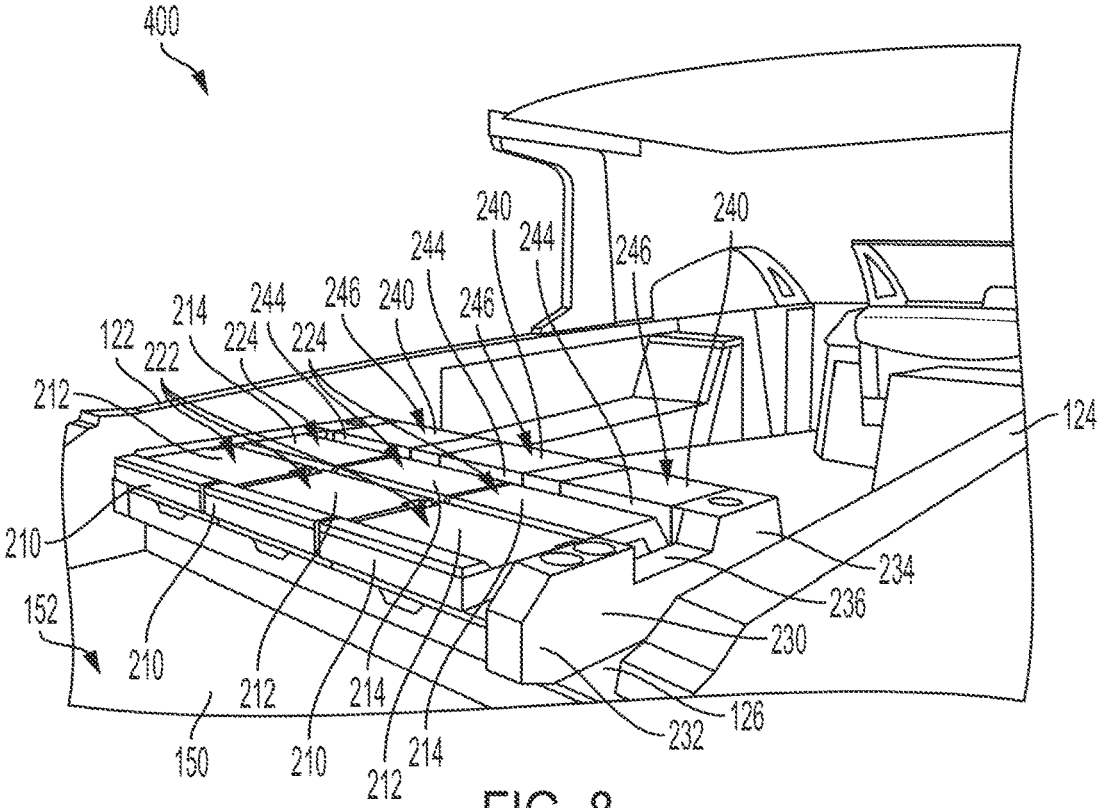
FIG. 8 is the view of FIG. 3 showing another preferred embodiment of the aft-facing seating configuration with the retractable seats in the retracted position.
Figure 9:
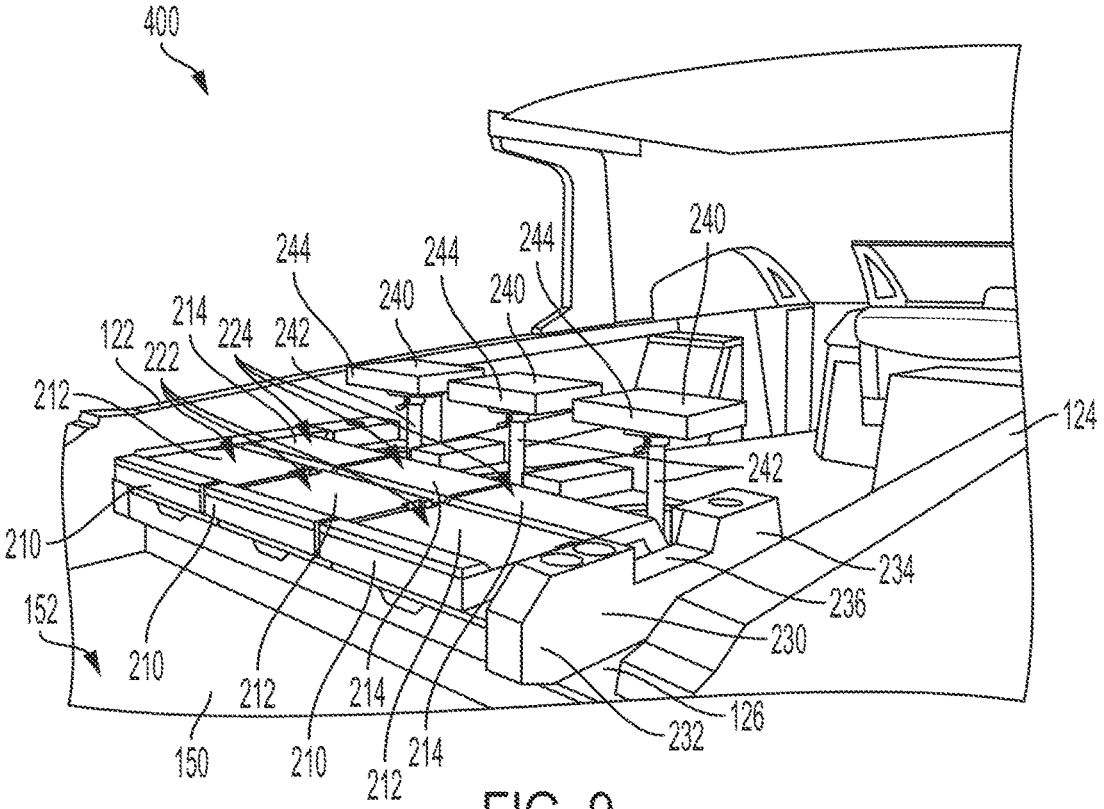
FIG. 9 is the aft-facing seating configuration shown in FIG. 8 with the retractable seats in the raised position.

FIGS. 8 and 9 show a further embodiment of an aft-facing seating configuration 400. FIG. 8 is the view of FIG. 3 showing the retractable seats 240 in the retracted position, and FIG. 9 shows the retractable seats 240 in the raised position. The aft-facing seating configuration 400 of this embodiment is similar to the previous embodiments, but the upper surface 246 of the cushion 244 of the retractable seat 240 in the retracted position is the same height the upper surface 222 of the aft member 212 of the sun pad seat 210.

Figure 10:
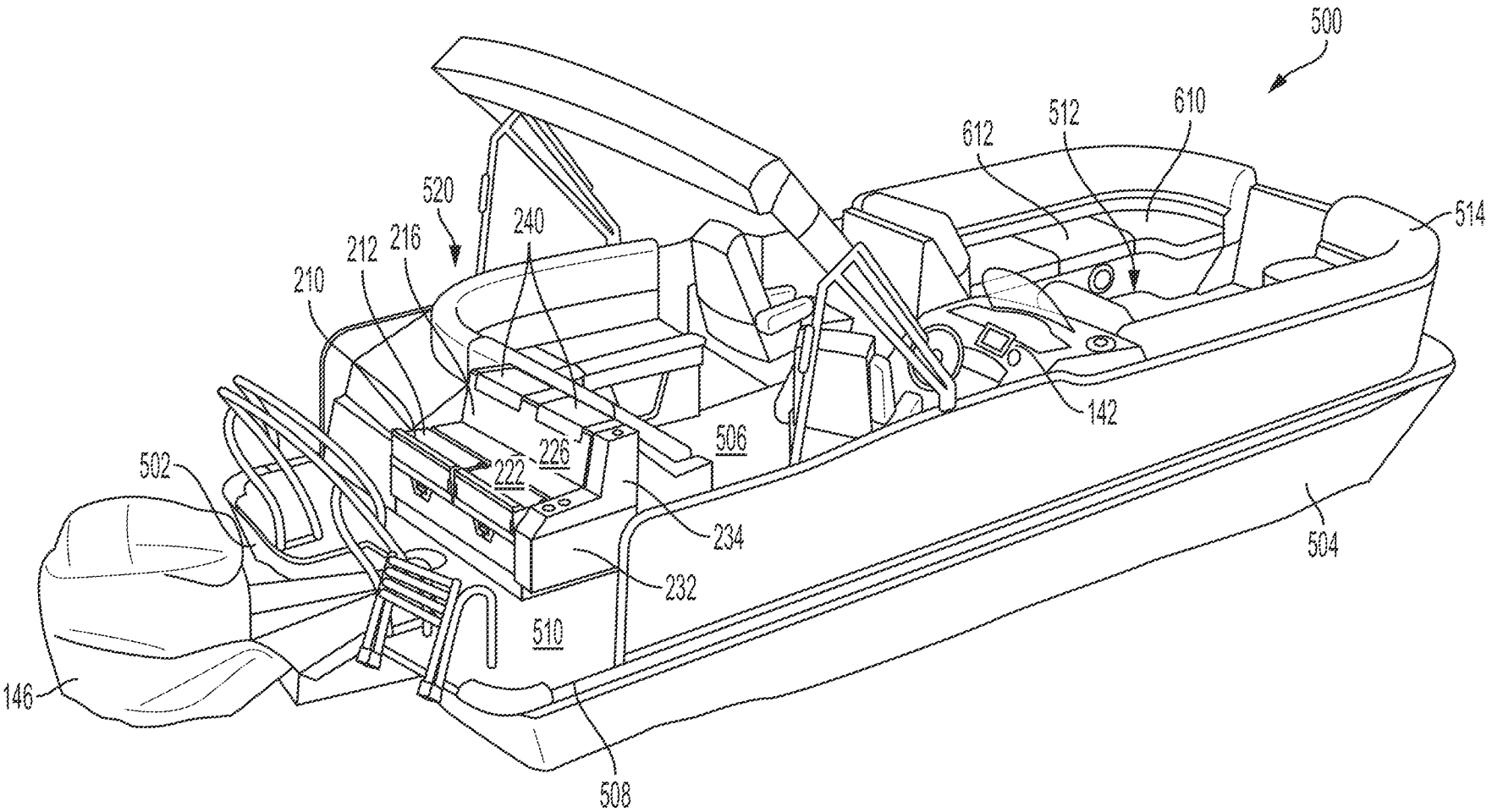
FIG. 10 shows another boat including an aft-facing seating configuration according to a preferred embodiment of the invention.
Figure 11:
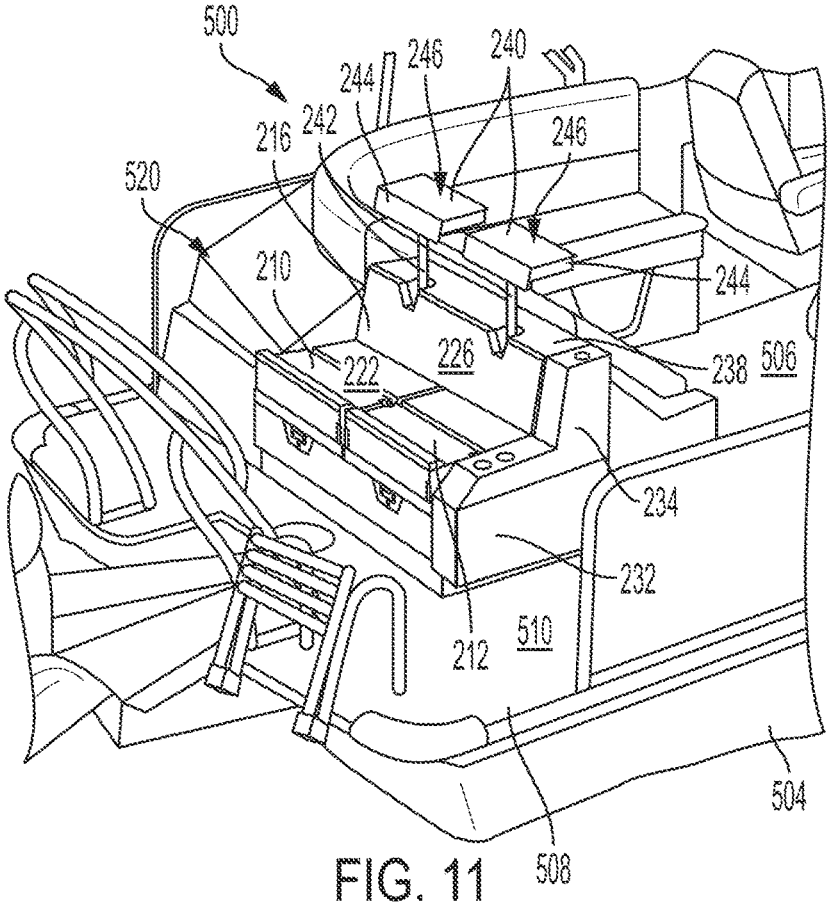
FIG. 11 is a perspective view of a stern portion of the boat shown in FIG. 10 with the retractable seats of the aft-facing seating configuration in a raised position.

As discussed above, the aft-facing seating configurations 200, 300, 400 may be used with any suitable boat. FIGS. 10 and 11, for example, show a pontoon boat 500 equipped with an aft-facing seating configuration 520 similar to the aft-facing seating configuration 200 shown in FIGS. 1-6. Although the aft-facing seating configuration 520 is not so limited, the first aft-facing seat 210 shown in FIGS. 10 and 11 includes an aft member 212 and a backrest 216 and does not include a moveable forward member 214.

The pontoon boat 500 of this embodiment includes at least a port-side pontoon 502 and a starboard-side pontoon 504 and is propelled by an outboard motor 146. The port-side pontoon 502 and the starboard-side pontoon 504 are oriented in a longitudinal direction of the boat 100, which extends in a fore and aft direction of the boat 500. A plurality of cross beams (not shown) are connected to an upper side of each of the port-side pontoon 502 and the starboard-side pontoon 504 in a direction transverse to the longitudinal direction of the boat 500, which transverse direction in this embodiment is a port and starboard direction of the boat 500. The cross beams support a deck 506 of the boat 500, which also includes a stern deck 508. In this embodiment, the first aft-facing seat 210 is an aft-facing seat located on the stern deck 508 of the boat 500. The stern deck 508 may be used similarly to the reboarding platform 150, discussed above. For example, an upper surface 510 of the stern deck 508 may be used as a seating surface as part of the aft-facing seating configuration 520.

Figure 12:
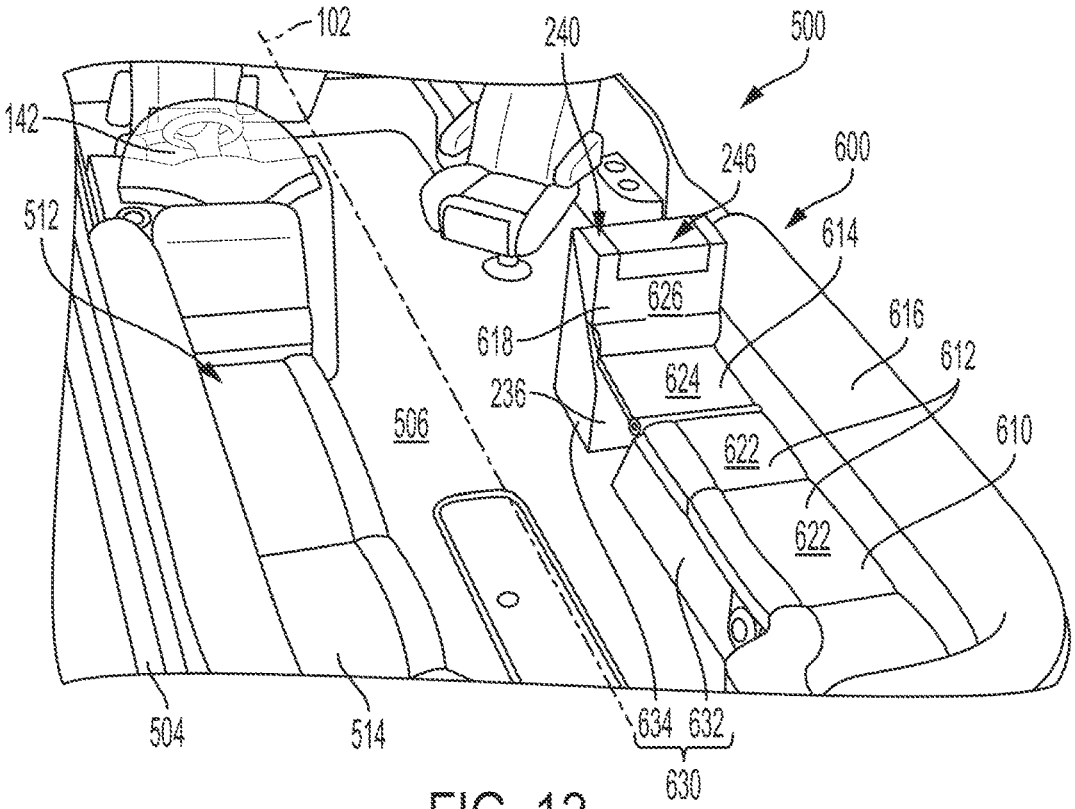
FIG. 12 is a perspective view of a bow portion of the boat shown in FIG. 10 showing a multi-level seating configuration according to a preferred embodiment of the invention.
Figure 13:
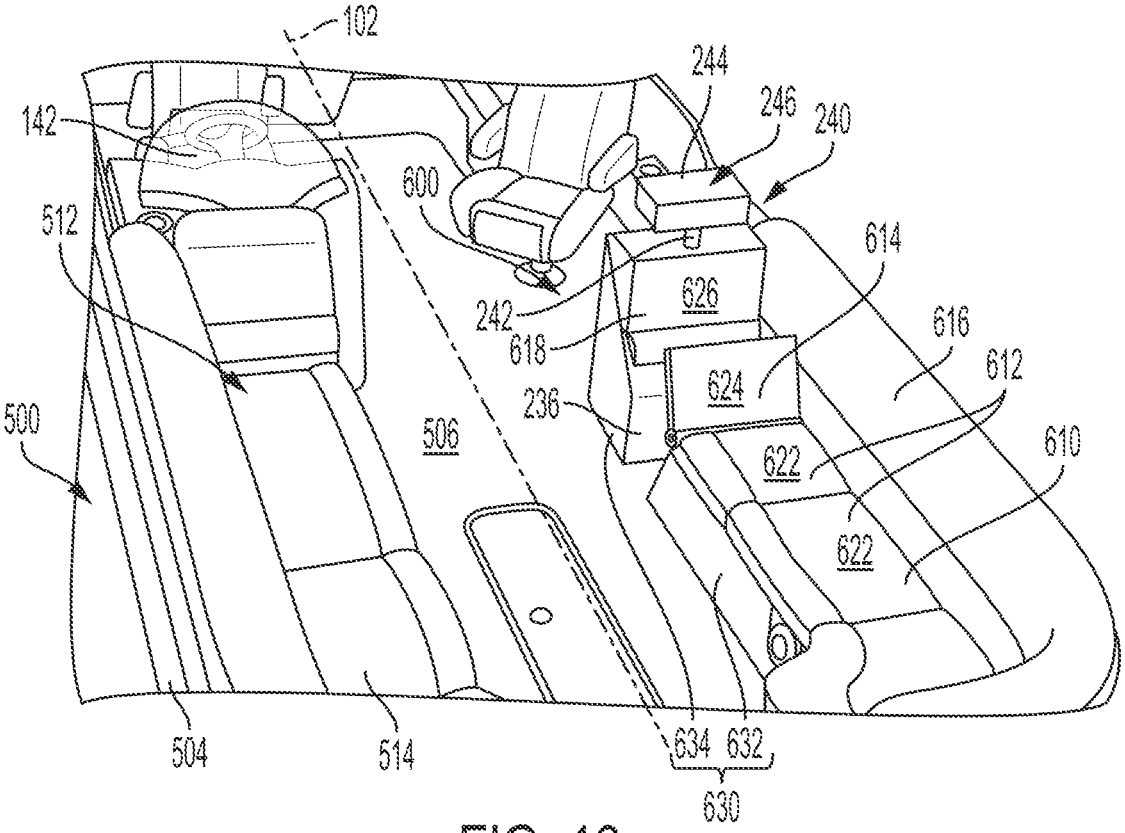
FIG. 13 is the perspective view of the bow portion of the boat shown in FIG. 12 with a retractable seat of the multi-level seating configuration in a raised position.

Although described above as aft-facing seating configurations, the various features of the seating configurations described herein may be used in other portions of the boat to form, for example, other multi-level seating configurations. For example, FIGS. 12 and 13 show a multi-level seating configuration 600 in a forward seating area 512 of the boat 500 shown in FIG. 10. The forward seating area 512 of this embodiment includes a port-side bench seat 610 and a starboard-side bench seat 514 located, respectively, on the port side and the starboard side of the centerline 102 of the boat 500. In this embedment, the forward seating area 512 is located forward of the control console 142 for operating the boat 500.

Although it may be also used with the starboard-side bench seat 514, the multi-level seating configuration 600 is described with respect to the port-side bench seat 610. The port-side bench seat 610 is an elongated seat that extends from just forward of the control console 142 to the front of the boat 500. The port-side bench seat 610 of this embodiment includes a main seat bottom 612 and a moveable seat bottom 614. Each of the main seat bottom 612 and the moveable seat bottom 614 is a cushion attached to a structural member, such as a plate or a frame. Multiple cushions may be used to form the main seat bottom 612. In this embodiment, the main seat bottom 612 is constructed and operates similarly to the aft member 212 of the sun pad seat 210, discussed above. The moveable seat bottom 614 operates similarly to the forward member 214 of the sun pad seat 210, discussed above, and is moveable between a reclined position (shown in FIG. 12) and an inclined position (shown in FIG. 13). Each of the main seat bottom 612 and the moveable seat bottom 614 also includes an upper surface 622, 624. In the reclined position, the upper surface 622 of the main seat bottom 612 and the upper surface 624 of the moveable seat bottom 614 are at substantially the same height, forming a substantially flat surface and a continuous bench seat.

With the moveable seat bottom 614 in the reclined position, an occupant of the port-side bench seat 610 may suitably sit in a center-facing position and also in a forward-facing position. In the center-facing position, the occupant may sit with their feet on the deck 506, their buttocks on the main seat bottom 612 or the moveable seat bottom 614, and their back on a center-facing backrest 616. In this embodiment, the center-facing backrest 616 is formed on an inboard side of the fence panels on the port side of the boat 500. The port-side bench seat 610 also includes a forward-facing backrest 618, which is constructed similarly to the backrest 216 of the sun pad 210, discussed above. In the forward-facing positing, the occupant may sit with their buttocks on the moveable seat bottom 614, their back on the forward-facing backrest 618, and their legs stretched in a forward direction on the main seat bottom 612.

With the moveable seat bottom 614 in the inclined position, the moveable seat bottom 614 may be used as a backrest with the back of the occupant on the moveable seat bottom 614, the buttocks of the occupant on the main seat bottom 612, and their legs stretched in a forward direction on the main seat bottom 612. Similar to the sun pad seat 210 discussed above, in this embodiment, the occupant faces directly forward when the port-side bench seat 610 is occupied in a forward-facing orientation; that is, the plane of the upper surface 624 of the moveable seat bottom 614 and a forward-facing surface 626 of the forward-facing backrest 618 are generally orthogonal to the centerline 102 of the boat 500. However, the port-side bench seat 610 does not need to be positioned to face the occupant directly forward. Instead, variations are contemplated to be within the scope of the invention, including, for example, angling the upper surface 624 of the moveable seat bottom 614 or the forward-facing surface 626 of the forward-facing backrest 618 up to and including 45° relative to the centerline 102 of the boat 500.

The port-side bench seat 610 of this embodiment also includes a seat support structure 630. The seat support structure 630 includes two portions that are elevated with respect to the deck 506 of the boat 500: a forward elevated portion 632 and an aft elevated portion 634. As with the seat support structure 230 of the sun pad seat 210, the forward elevated portion 632 is separated from the aft elevated portion 634 by a foot surface 236. The moveable seat bottom 614 spans the foot surface 236 in the reclined position. The forward-facing backrest 618 is a cushion mounted to a forward-facing surface of the aft elevated portion 634.

The multi-level seating configuration 600 of this embodiment also includes a retractable seat 240. FIG. 12 shows the retractable seat 240 in the retracted position, and FIG. 13 shows the retractable seat 240 in a raised position. The retractable seat 240 is positioned such that, in the retracted position, the bottom of the cushion 244 rests on an upper surface of the aft elevated portion 634. When an occupant is seated in a forward-facing position on the retractable seat 240, they are seated on the upper surface 246 of the cushion 244 with their feet forward, over the forward-facing backrest 618. When the moveable seat bottom 614 of the port-side bench seat 610 is in its inclined position, the moveable seat bottom 614 exposes the foot surface 236 of the deck and is a place on which a person seated on the retractable seats 240 can place their feet.

Similarly to the sun pad seat 210, the multi-level seating configuration 600 of this embodiment provides for comfortable multi-level forward viewing positions. In this embodiment, the upper surface 246 of the cushion 244 of the retractable seat 240 is higher than the upper surface 622 of the main seat bottom 612 of the port-side bench seat 610 in all positions. This allows the person seated on the retractable seat 240 to be comfortably seated with their view in the forward direction unobstructed by the person in front of them seated on the port-side bench seat 610. Other configurations of the retractable seat in the multi-level seating configuration 600, however, are contemplated to be within the scope of the invention. For example, in the retracted position, the upper surface 246 of the cushion 244 of the retractable seat 240 of this embodiment may be at substantially the same height as the upper surface 622 of the main seat bottom 612 of the port-side bench seat 610, similar to the aft-facing seating configuration 400 shown in FIGS. 8 and 9.

While the foregoing discussion references certain materials, those skilled in the art will recognize that any material suitable for use in a marine environment and having other suitable characteristics for performing the functions discussed above (for example, strength and wear resistance) may be used in this invention.

Although this invention has been described with respect to certain specific preferred embodiments, many additional modifications and variations will be apparent to those skilled in the art in light of this disclosure. It is, therefore, to be understood that this invention may be practiced otherwise than as specifically described. Thus, the preferred embodiments of the invention should be considered in all respects to be illustrative and not restrictive, and the scope of the invention to be determined by any claims supportable by this application and the equivalents thereof, rather than by the foregoing description.

What is claimed is:

1. A boat comprising:

a cockpit seating area including at least one seat and a control console for operating the boat;

a deck; and a seating assembly located on the deck, the seating assembly including:

a first seat located on the deck and having a first seating surface; and a second seat located on the deck and having a second seating surface, the second seating surface being moveable between a retracted position and at least one raised position, the second seating surface being configured to be a seat bottom in both the retracted position and the at least one raised position.

2. The boat of claim 1, wherein the height of the second seating surface in the retracted position is substantially the same height as the first seating surface.

3. The boat of claim 1, wherein the height of the second seating surface in the retracted position is at a level higher than the first seating surface.

4. The boat of claim 1, wherein the second seating surface is moveable to a plurality of raised positions, the level of the second seating surface, in each raised position, being higher than the level of the first seating surface.

5. The boat of claim 1, wherein the second seat does not include a seatback.

6. The boat of claim 1, wherein the second seat is configured to support a plurality of persons seated on the second seating surface side-by-side.

7. The boat of claim 1, further comprising a plurality of the second seats, each of the second seating surfaces of the plurality of the second seats being individually moveable between a retracted position and at least one raised position.

8. The boat of claim 1, wherein the second seating surface is aft of the first seating surface.

9. The boat of claim 1, wherein the second seating surface is forward of the first seating surface.

10. The boat of claim 1, further comprising a stern seating area, wherein the stern seating area is aft of the cockpit seating area and the seating assembly is located in the stern seating area.

11. The boat of claim 1, further comprising a bow seating area, wherein the bow seating area is forward of the cockpit seating area and the seating assembly is located in the bow seating area.

12. The boat of claim 1, wherein the first seat is a bench seat that is elongated in a fore and aft direction of the boat.

13. The boat of claim 12, wherein the second seating surface is aft of the first seating surface.

14. A boat comprising:

a deck;

a first seat located on the deck, the first seat including:

a main member having an upper surface, the upper surface of the main member being a first seating surface; and a moveable member having an upper surface, the moveable member being moveable between a first position and a second position, wherein, in the first position, the upper surface of the moveable member forms a substantially flat surface with the upper surface of the main member and, in the second position, the upper surface of the moveable member is inclined upward relative to the upper surface of the main member; and a second seat located on the deck and having a second seating surface, the second seating surface being at a level higher than the first seating surface.

15. The boat of claim 14, wherein the deck includes a foot surface, the foot surface being a portion of the deck underneath the moveable member of the first seat when the moveable member is in the first position, wherein, when the moveable member of the first seat is in the second position, the foot surface is exposed, and wherein the second seat is positioned relative to the first seat such that, when the moveable member of the first seat is in the second position and the second seat is occupied by a person, the foot surface is configured for the feet of the person occupying the second seat to be placed thereon.

16. The boat of claim 14, wherein the first seat further includes a seatback inclined upward relative to the upper surface of the moveable member in the first position.

17. The boat of claim 16, wherein the second seat includes a seat bottom having the second seating surface, and the seatback of the first seat is underneath the seat bottom of the second seat.

18. The boat of claim 14, further comprising a forward seating area, wherein the first seat and second seat are located in the forward seating area.

19. The boat of claim 14, further comprising at least one bench seat on at least one of a port-side of the boat and a starboard-side of the boat, wherein the first seat is the at least one bench seat.

20. The boat of claim 19, wherein the moveable member is aft of the main member, and the second seat is aft of the first seating surface.

* * * * *